US010531709B2

(12) United States Patent
McInulty

(10) Patent No.: US 10,531,709 B2
(45) Date of Patent: Jan. 14, 2020

(54) MOTORCYCLE FOOTWEAR SOLE

(71) Applicant: Jason McInulty, Maidstone (GB)

(72) Inventor: Jason McInulty, Maidstone (GB)

( * ) Notice: Subject to any disclaimer, the term of this patent is extended or adjusted under 35 U.S.C. 154(b) by 115 days.

(21) Appl. No.: 13/790,648

(22) Filed: Mar. 8, 2013

(65) Prior Publication Data

US 2013/0232822 A1 Sep. 12, 2013

(30) Foreign Application Priority Data

Mar. 9, 2012 (GB) ..... 1204207.3

(51) Int. Cl.
*A43C 15/02* (2006.01)
*A43B 5/14* (2006.01)

(52) U.S. Cl.
CPC ..... *A43C 15/02* (2013.01); *A43B 5/145* (2013.01)

(58) Field of Classification Search
CPC ..... A43C 15/02; A43C 19/00; A43B 5/14; A43B 5/145; A43B 13/141; A43B 13/143
USPC ..... 36/103, 115, 131, 132, 136, 61, 62, 114; 623/23, 30, 53; 74/594.1
See application file for complete search history.

(56) References Cited

U.S. PATENT DOCUMENTS 589,443 A * 9/1897 Rathbun ..... A43C 15/161 36/131
3,668,792 A * 6/1972 York ..... A43B 5/00 36/114
3,906,645 A * 9/1975 Heckel ..... A43B 1/0018 36/131
4,188,737 A * 2/1980 Haver ..... A43B 1/0036 36/131
4,291,473 A * 9/1981 Sartor ..... A43B 5/0419 36/132
4,348,821 A * 9/1982 Daswick ..... A43B 13/12 36/103
4,364,190 A * 12/1982 Yonkers ..... A43B 13/223 36/114
4,538,480 A * 9/1985 Trindle ..... A43B 5/14 24/697.1
4,563,825 A * 1/1986 Tesser ..... A43B 5/0427 36/118.9
4,596,163 A * 6/1986 Bon ..... B62M 3/083 36/131
4,640,027 A * 2/1987 Berlese ..... A43B 7/08 36/131
4,646,586 A * 3/1987 Rapisarda ..... B62M 3/086 280/623
4,662,090 A * 5/1987 Solano ..... A43B 5/14 36/131

(Continued)

FOREIGN PATENT DOCUMENTS

GB 2100579 A * 1/1983 ..... A43B 3/26
GB 2202448 A * 9/1988 ..... A61F 2/60

(Continued)

*Primary Examiner* — Shaun R Hurley
*Assistant Examiner* — Bao-Thieu L Nguyen
(74) *Attorney, Agent, or Firm* — Kilpatrick Townsend & Stockton LLP

(57) ABSTRACT

A motorcycle riding footwear sole comprising a projection suitable for engaging the underside of a motorcycle foot peg so as to prevent vertical movement of the sole relative to the foot peg, and characterized by further comprising a recess for receiving a brake or gear lever of a motorcycle.

3 Claims, 2 Drawing Sheets

(56) References Cited

U.S. PATENT DOCUMENTS 4,794,817 A * 1/1989 Romano ..... B62M 3/086 74/594.4
4,815,333 A * 3/1989 Sampson ..... B62M 3/086 36/131
5,007,185 A * 4/1991 Lazarski ..... A43B 5/14 36/131
5,199,726 A * 4/1993 Willett ..... A43B 5/1641 280/11.27
5,251,508 A * 10/1993 Robbins ..... A43B 5/14 36/131
5,694,706 A * 12/1997 Penka ..... A43B 5/00 36/103
5,704,139 A * 1/1998 Okajima ..... A43B 5/0401 280/613
5,727,429 A * 3/1998 Ueda ..... A43B 5/14 36/131
5,845,421 A * 12/1998 Tanaka ..... A43B 5/0401 36/115
5,974,699 A * 11/1999 Park ..... A43B 13/148 36/103
6,226,900 B1 * 5/2001 Mazars ..... A43B 5/00 36/107
6,272,773 B1 * 8/2001 Sjosvard ..... A43B 5/006 36/131
6,286,855 B1 * 9/2001 Paris ..... A43B 5/0417 280/608
6,826,853 B1 * 12/2004 Zanatta ..... A43B 3/0052 36/118.2
7,386,948 B2 * 6/2008 Sink ..... A43B 5/001 36/127
7,644,521 B2 * 1/2010 McCarron ..... A43B 5/145 36/103
8,794,105 B2 * 8/2014 Delgorgue ..... A43B 5/14 74/594.6
9,609,905 B1 * 4/2017 Leko ..... B62M 3/086
2002/0026730 A1 * 3/2002 Whatley ..... A43B 13/143 36/132
2002/0177906 A1 * 11/2002 Phillips ..... A61F 2/60 623/27
2005/0022424 A1 * 2/2005 Held ..... A43B 7/1425 36/30 R
2006/0101672 A1 * 5/2006 Valat ..... A43B 5/145 36/131
2006/0288611 A1 * 12/2006 Hogan ..... A43B 7/18 36/25 R
2007/0000153 A1 * 1/2007 Harrington ..... A43B 5/14 36/131
2007/0219643 A1 * 9/2007 Townsend ..... A61F 2/60 623/55
2008/0127514 A1 * 6/2008 Sussmann ..... A43B 1/0009 36/88
2008/0134545 A1 * 6/2008 Suzuki ..... A43B 5/007 36/131
2008/0179859 A1 * 7/2008 Boehmke ..... A43B 5/145 280/291
2009/0119949 A1 * 5/2009 Song ..... A43B 13/146 36/103
2009/0178303 A1 * 7/2009 Hurd ..... A43B 13/026 36/107
2009/0204231 A1 * 8/2009 Bonacini ..... A61F 2/66 623/55
2009/0205462 A1 * 8/2009 Harrington ..... 74/594.4
2009/0272008 A1 * 11/2009 Nomi ..... A43B 13/16 36/91
2010/0083540 A1 * 4/2010 Allen ..... A43B 1/0081 36/136
2010/0263233 A1 * 10/2010 Hansen ..... A43B 13/145 36/103
2011/0047827 A1 * 3/2011 Diekman ..... A43B 13/183 36/103
2011/0061265 A1 * 3/2011 Lyden ..... A43B 1/0081 36/103
2011/0219911 A1 * 9/2011 Zoumaras ..... B62J 25/00 74/594.6
2011/0239817 A1 * 10/2011 Chang ..... A43B 5/14 74/594.6
2012/0017470 A1 * 1/2012 Pan ..... A43B 3/108 36/103
2012/0240430 A1 * 9/2012 Shin ..... A43B 5/14 36/103
2013/0232822 A1 * 9/2013 McInulty ..... A43B 5/145 36/103
2014/0013625 A1 * 1/2014 Grott ..... A43B 5/001 36/103
2014/0259791 A1 * 9/2014 Stull ..... A43B 13/223 36/103

FOREIGN PATENT DOCUMENTS

WO WO 9100070 A1 * 1/1991 ..... A61F 2/66
WO WO 9324080 A1 * 12/1993 ..... A61F 2/66

* cited by examiner

MOTORCYCLE FOOTWEAR SOLE

FIELD OF INVENTION

The present invention relates generally to the field of footwear for motorcycle riding, and, in particular, to a sole for motorcycle footwear.

BACKGROUND TO THE INVENTION

The bottom part, otherwise referred to as the sole, of footwear for motorcycle riding is conventionally intended to come in repeated contact with motorcycle foot pegs. Motorcycle foot pegs are rigid members that typically project outwardly from either side of a motorcycle and are designed to support the foot of a rider.

When riding a motorcycle, the rider will therefore typically position each foot on a respective foot peg of the motorcycle. The sole of the footwear being worn by the rider may therefore contact foot pegs and transfer weight of the rider onto the foot pegs. In this way, the rider may be supported (at least in part) on the motorcycle by the foot pegs. Further, the rider may apply forces to the foot pegs to control movement of the motorcycle when it is moving.

Soles of motorcycle footwear have been made from plant fibers, leather, wood, rubber, synthetics, plastic, and various combinations of these materials. Such soles can be formed form a single material in a single layer, or they can be formed in a complex manner with multiple structures or layers and materials.

SUMMARY OF THE INVENTION

Proposed is a motorcycle riding footwear sole comprising a projection suitable for engaging the underside of a motorcycle foot peg so as to prevent vertical movement of the sole relative to the foot peg.

The sole may be provided with a both a downwardly facing surface suitable for engaging the upper side/surface of a motorcycle foot peg and an upwardly facing surface for engaging the lower side/surface of the motorcycle foot peg. Thus, a wearer of motorcycle footwear comprising a sole according to an embodiment may be able to impart both downwardly and upwardly directed forces on a motorcycle peg when riding the motorcycle.

Embodiments of the sole may therefore be adapted so that the motorcycle riding footwear it is provided on may be positioned by the wearer with ease, to slip around a motorcycle foot peg and contact the underside of the foot peg. This may help the rider by allowing transfer of weight through the use of their feet and legs, and may further enable the rider to pull upwardly on the foot peg. Thus, if the motorcycle starts moving about when cornering at high speeds, for example, embodiments may enable the rider to gain more control of the motorcycle by applying an upwardly directed force to the foot pegs (and therefore the motorcycle).

BRIEF DESCRIPTION OF THE DRAWINGS

Examples of the invention will now be described in detail with reference to the accompanying drawings, in which.

DETAILED DESCRIPTION

The same reference numbers have been used in different figures to denote the same or similar features.

Figure 1:
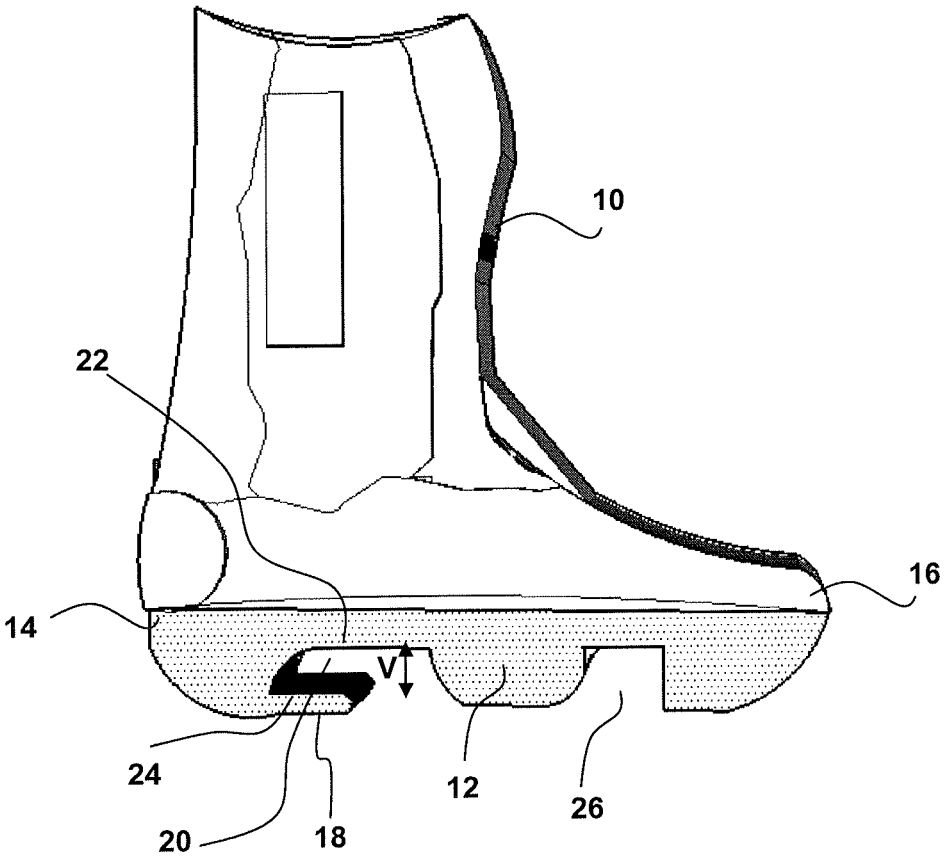
FIG. 1 is an illustration of a side view of a motorcycle riding boot comprising a sole according to an embodiment of the invention.
Figure 2:
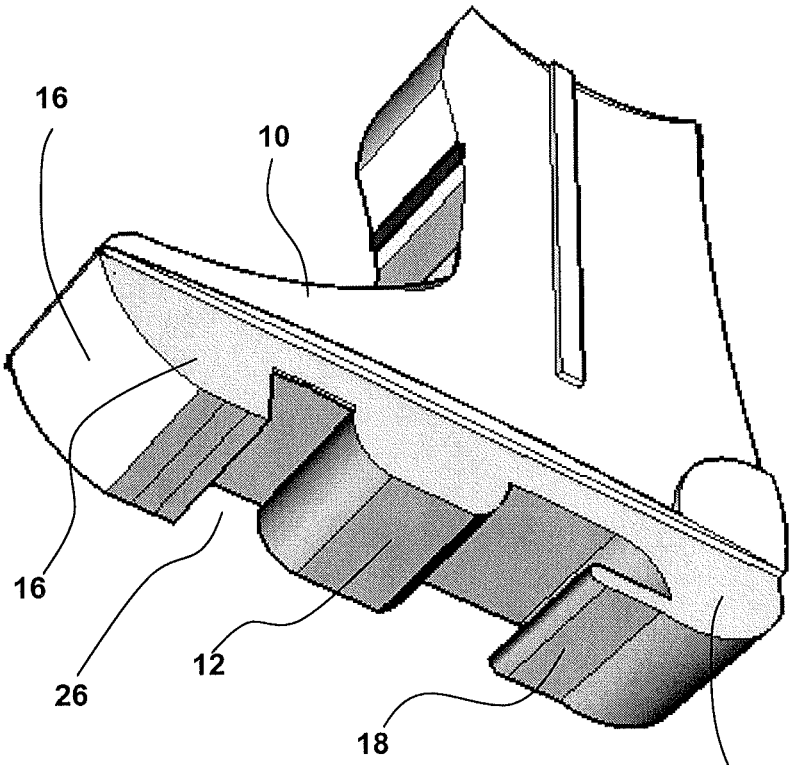
FIG. 2 is an illustration showing the underside of the motorcycle riding boot of FIG. 1.

Referring to FIGS. 1 and 2, there is illustrated motorcycle riding boot 10 comprising a sole 12 according to an embodiment of the invention. The sole 12 provided at the bottom part of the riding boot 10 and is adapted to come in repeated contact with motorcycle foot pegs.

The boot 10 and sole 12 can be described as comprising a heel end 14 and a toe end 16, describing the relative position of the boot 10 and sole 12 to a wearer's foot when in use (i.e. when the boot is being worn). Towards the heel end 14 of the sole, the sole is provided with a projection 18 that extends substantially horizontally in the longitudinal direction of the boot/sole. In other words, the projection 18 extends from the heel end 14 of the sole 12 towards the toe end 16 of the sole 12 and lies substantially in the horizontal plane.

The projection 18 thus defines a recess or void 20 in the sole 12 between a downwardly facing surface 22 of the sole 12 and an upwardly facing surface 24 of the sole 12. The void 20 is sized such that it has a vertical extent (indicated by the arrow labeled "V") that is at least equal to or greater than that of a motorcycle foot peg. As a result, a motorcycle foot peg may be slid into the void 20 with the projection 18 positioned below the foot peg.

It will therefore be understood that the downwardly facing surface 22 of the sole is suitable for engaging the upper side/surface of a motorcycle foot peg. Also, the upwardly facing surface 24 of the sole is suitable for engaging the lower side/surface of the motorcycle foot peg. Thus, the sole 12 may be used to impart both downwardly and upwardly directed forces on a motorcycle peg when the foot peg is positioned within the void 20.

The projection 18 is suitable for engaging the underside of a motorcycle foot peg so as to prevent vertical movement of the sole 12 relative to the foot peg. Contact made between the upwardly facing surface 24 of the projection and the underside (i.e. downwardly facing side) of the foot peg restricts movement of the sole 12 relative to the motorcycle foot peg and enables a wearer of the riding boot to impart an upwardly directed pulling force on the motorcycle foot peg. The sole 12 can therefore impart both downwardly and upwardly directed forces on a motorcycle peg that is positioned within the void 20.

Embodiments of the sole may therefore be adapted so that the motorcycle riding footwear it is provided with may be positioned by the wearer with ease, to slip around a motorcycle foot peg and contact the underside of the foot peg (as and when may be required). This may help the rider by allowing transfer of weight through the use of their feet and legs, and may further enable the rider to pull upwardly on the foot peg. Thus, if the motorcycle starts moving about when cornering at high speeds, for example, the sole may enable the rider to gain more control of the motorcycle by applying an upwardly directed force to the foot pegs (and therefore the motorcycle).

Towards the toe end 16 of the sole 12, the sole 12 is provided with a recess 26 for receiving a rear brake or gear lever of a motorcycle. At least one of the lateral extent and depth of the recess 26 is preferably equal to or greater than a dimension of a rear brake or gear lever of a motorcycle.

The sole 12 may comprise a single piece of material that can subsequently attached to motorcycle riding footwear (such as a motorcycle racing boot for example). Alternatively, the sole 12 may be an assembly of separate pieces of different materials. The heel of the sole may have a rubber plate for durability and traction, while the front may be formed from a different material according to requirements.

Embodiments of the invention may provide improved control of a motorcycle when being ridden. For example, a sole according to an exemplary embodiment may comprise a recess for receiving a motorcycle foot peg, wherein the recess is provided with a lip that is suitable for contacting the underneath of the foot peg so as to restrict movement of the sole relative to the foot peg in at least one direction. Such a sole may be arranged to not clip-on or attach to the motorcycle foot peg, thus enabling quick removal of sole from the foot peg (in case of an accident or racing incident, for example). Instead, the sole may be arranged such that it may simply slip off or away from the motorcycle foot peg, allowing a rider to quickly and easily disengage from the motorcycle and avoid being trapped or hooked onto the foot pegs.

As will be apparent from the description and the accompanying drawings, embodiments are adapted to engage with the underside of a motorcycle foot peg and restrict or prevent movement of the sole relative to the foot peg. Thus, unlike conventional soles for motorcycle footwear, embodiments of the invention enable an upwardly directed force to be applied to the foot peg by a wearer/rider using the sole.

It will be apparent to those skilled in the art that variations and modifications may be made without departing from the invention.

The invention claimed is:

1. A motorcycle riding footwear sole comprising:

a projection disposed between a heel-end of the motorcycle riding footwear sole and a toe-end of the motorcycle riding footwear sole, the projection rigidly and integrally formed with the motorcycle riding footwear sole, wherein the projection has a top side facing a bottom surface of the motorcycle riding footwear sole;

a first recess disposed between the projection and the bottom surface of the motorcycle riding footwear sole, wherein the first recess has a convex toe-side wall angled towards the toe-end of the motorcycle riding footwear sole, wherein the first recess has a concave heel-side wall angled towards the heel-end of the motorcycle riding footwear sole, wherein a distance from a front portion of the first recess to a rear portion of the first recess is greater than a distance between the projection and the bottom surface of the motorcycle riding footwear sole, and wherein the first recess is adapted to receive a motorcycle foot peg; and a second, separate recess disposed towards the toe-end of the motorcycle riding footwear sole wherein the second, separate recess comprises a linear side, a convex curvilinear side, and a top surface, wherein a height of the linear side is equal to or greater than a depth of a brake or gear lever of a motorcycle.

2. A motorcycle riding boot comprising a motorcycle riding footwear sole according to claim 1.

3. The motorcycle riding footwear sole of claim 1, wherein the projection extends horizontally across the entire width of the motorcycle riding footwear sole.

* * * * *